US007407203B2

(12) United States Patent
Huizenga et al.

(10) Patent No.: US 7,407,203 B2
(45) Date of Patent: Aug. 5, 2008

(54) VEHICLE DOOR HANDLE

(75) Inventors: David J. Huizenga, Holland, MI (US); Timothy A. Hornshaw, Holland, MI (US); Richard C. Behm, Jr., Spring Lake, MI (US)

(73) Assignee: Donnelly Corporation, Holland, MI (US)

( * ) Notice: Subject to any disclaimer, the term of this patent is extended or adjusted under 35 U.S.C. 154(b) by 202 days.

(21) Appl. No.: 11/206,460

(22) Filed: Aug. 18, 2005

(65) Prior Publication Data

US 2006/0038418 A1 Feb. 23, 2006

Related U.S. Application Data

(60) Provisional application No. 60/522,121, filed on Aug. 18, 2004.

(51) Int. Cl.
*E05B 3/00* (2006.01)

(52) U.S. Cl. ..... 292/347; 292/DIG. 22

(58) Field of Classification Search ..... 292/336.3, 292/DIG. 22, 347
See application file for complete search history.

(56) References Cited

U.S. PATENT DOCUMENTS

| | | | |
|---|---|---|---|
| 3,667,315 | A | 6/1972 | Polly |
| 3,737,944 | A | 6/1973 | Szabo et al. |
| 3,813,729 | A | 6/1974 | Szabo et al. |
| 3,908,149 | A | 9/1975 | Gergoe et al. |
| 4,041,301 | A | 8/1977 | Pelchat |
| 4,349,722 | A | 9/1982 | Kurth et al. |
| 4,471,209 | A | 9/1984 | Hollander |
| 4,580,822 | A | 4/1986 | Fukumoto |
| 4,686,741 | A | 8/1987 | Moore et al. |
| 4,837,892 | A | 6/1989 | Lo |
| 4,892,342 | A | 1/1990 | Newman et al. |
| 4,914,779 | A | 4/1990 | Nakai et al. |
| 5,129,694 | A | 7/1992 | Taninoto et al. |
| 5,297,010 | A | 3/1994 | Camarota et al. |
| 5,298,306 | A | 3/1994 | Miller |

(Continued)

FOREIGN PATENT DOCUMENTS

DE 3136468 A1 3/1983

(Continued)

OTHER PUBLICATIONS

JP Laying—open gazette No. 1-278835, Nov. 1989.

(Continued)

*Primary Examiner*—Gary Estremsky
(74) *Attorney, Agent, or Firm*—Van Dyke, Gardner, Linn & Burkhart LLP

(57) ABSTRACT

A door handle assembly for opening a door of a vehicle includes a handle portion and a lever or actuating member for actuating or releasing a latch mechanism of a vehicle door. The door handle assembly includes fewer components than known door handles and is reversible or suitable for use at either side of the vehicle. The door handle assembly may include a counterweight and lever mechanism at the base of the door handle assembly, such that the components do not extend substantially into the door cavity. The counterweight may be positioned rearwardly and outwardly of a pivot axis of the lever mechanism when the handle is at an initial or non-opening position, thereby providing enhanced retention of the door handle assembly during vehicle collisions.

9 Claims, 9 Drawing Sheets

U.S. PATENT DOCUMENTS

| | | | |
|---|---|---|---|
| 5,390,572 | A | 2/1995 | Gakhar et al. |
| 5,398,369 | A | 3/1995 | Heinzelman et al. |
| 5,497,641 | A | 3/1996 | Linde et al. |
| 5,530,989 | A | 7/1996 | Remert et al. |
| 5,648,788 | A | 7/1997 | Bumsted |
| 5,651,163 | A | 7/1997 | Tamaki |
| 5,682,135 | A | 10/1997 | Labonde |
| 5,709,453 | A | 1/1998 | Krent et al. |
| 5,740,586 | A | 4/1998 | Gomas |
| 5,781,956 | A | 7/1998 | Kelsay et al. |
| 5,781,958 | A | 7/1998 | Meessmann et al. |
| 5,844,470 | A | 12/1998 | Garnault et al. |
| 5,857,241 | A | 1/1999 | Camp et al. |
| 5,956,799 | A | 9/1999 | Panaccione et al. |
| 6,018,841 | A | 2/2000 | Kelsay et al. |
| 6,036,244 | A | 3/2000 | Tyves et al. |
| 6,070,998 | A | 6/2000 | Jennings et al. |
| 6,075,294 | A | 6/2000 | Van den Boom et al. |
| 6,093,978 | A | 7/2000 | Benard et al. |
| 6,135,621 | A | 10/2000 | Bach et al. |
| 6,149,287 | A | 11/2000 | Pastrick et al. |
| 6,164,805 | A | 12/2000 | Hulse |
| 6,180,212 | B1 | 1/2001 | Single et al. |
| 6,218,933 | B1 | 4/2001 | Josserand et al. |
| 6,234,548 | B1 | 5/2001 | Mittelbach et al. |
| 6,239,693 | B1 | 5/2001 | Benard et al. |
| 6,304,168 | B1 | 10/2001 | Ohta et al. |
| 6,349,450 | B1 | 2/2002 | Koops et al. |
| 6,353,415 | B1 | 3/2002 | Ashtiani et al. |
| 6,367,295 | B1 | 4/2002 | Agostini et al. |
| 6,477,464 | B2 | 11/2002 | McCarthy et al. |
| 6,550,103 | B2 | 4/2003 | Koops et al. |
| 6,554,331 | B2 * | 4/2003 | Ciborowski et al. ..... 292/347 |
| 6,556,125 | B1 | 4/2003 | Röhrl |
| 6,577,228 | B1 | 6/2003 | Tsuchida et al. |
| 6,621,178 | B2 | 9/2003 | Morillon |
| 6,669,267 | B1 | 12/2003 | Lynam et al. |
| 6,700,476 | B1 | 3/2004 | Okada et al. |
| 6,709,033 | B2 * | 3/2004 | Jooss et al. ..... 292/336.3 |
| 6,795,032 | B2 | 9/2004 | Ieda et al. |
| 6,907,643 | B2 | 6/2005 | Koops et al. |
| 6,966,583 | B2 * | 11/2005 | Ji et al. ..... 292/231 |
| 6,969,101 | B2 | 11/2005 | Lynam et al. |
| 6,977,619 | B2 | 12/2005 | March et al. |
| 7,163,240 | B2 * | 1/2007 | Odahara ..... 292/347 |
| 2005/0134059 | A1 * | 6/2005 | Ichino ..... 292/336.3 |

FOREIGN PATENT DOCUMENTS

| | | | |
|---|---|---|---|
| DE | 4212291 | A1 | 10/1993 |
| DE | 19752974 | A1 | 9/1998 |
| DE | 29921826 | U1 | 4/2000 |
| EP | 0831194 | A1 | 3/1998 |
| EP | 1 006 028 | A2 | 6/2000 |
| EP | 1 206 002 | A2 | 5/2002 |
| GB | 2298748 | A | 9/1996 |
| JP | 10292702 | | 11/1998 |
| WO | WO 8807118 | | 9/1988 |
| WO | WO 00/44066 | | 7/2000 |

OTHER PUBLICATIONS

JP Laying—open gazette No. 1-299966, Dec. 1989.
JP Laying—open gazette No. 1-299967, Dec. 1989.

* cited by examiner

VEHICLE DOOR HANDLE

CROSS REFERENCE TO RELATED APPLICATION

The present application claims benefit of U.S. provisional application, Ser. No. 60/522,121, filed Aug. 18, 2004 which is hereby incorporated herein by reference in its entirety.

FIELD OF THE INVENTION

The present invention relates to door handles for vehicles and, more particularly, to an exterior door handle for opening a side door of a vehicle.

BACKGROUND OF THE INVENTION

Typically, a door handle for a vehicle may include a handle portion that is pivotable relative to a base portion, whereby pivotal movement of the handle portion pulls at a cable to move a latch mechanism to release the latch and open the door. The door handle is typically vehicle side specific, such that a vehicle typically requires at least two different door handles, a right door handle and a left door handle.

Due to the weight or mass of the pivotable handle portion, the handle portion tends to swing or pivot outward during a vehicle collision and may open the door of the vehicle during the collision. The door handle thus often includes a counterweight and lever mechanism that extends into the door cavity (behind the exterior panel of the door), in order to counter the weight and inertia of the pivotable handle portion to retain the door handle in its non-opening position during a vehicle collision. The counterweight, along with the other door handle components, often requires the door to have a greater width (or greater distance between the exterior door panel and the window, which may be lowered or rolled down to be within the door cavity) that is sufficient to receive the counterweight and door handle components when the door handle is mounted to the door.

SUMMARY OF THE INVENTION

The present invention provides a door handle assembly that includes fewer components than known door handles and that is reversible or suitable for use at either side of the vehicle. The present invention also provides a door handle assembly that includes a counterweight and lever mechanism at the base of the door handle assembly, such that the components do not extend substantially into the door cavity. The door handle or handles of the present invention are suitable for use at a side door of a vehicle and/or a sliding door of a vehicle.

According to an aspect of the present invention, a door handle assembly for a door of a vehicle includes a handle portion mountable to the vehicle door, a lever movably mounted to the handle portion, and an actuating member. The handle portion has first and second receiving portions and the actuating member is movably received in one of the first and second receiving portions. The actuating member is connected to a latch mechanism of the door. The actuating member moves in response to movement of the lever to release the latch mechanism to open the door of the vehicle. The door handle assembly is configured to mount to a door at either side of the vehicle. The actuating member is received in the first receiving portion for a mounting arrangement at a first side of the vehicle and received in the second receiving portion for a mounting arrangement at a second side of the vehicle.

The lever and/or actuating member may be pivotally mounted to the handle portion. The door handle assembly may include a spring or biasing element or member that biases the actuating member toward an initial position, whereby movement of the lever moves the actuating member away from the initial position. The lever may comprise a reduced size so that a counterweight is reduced or not included/needed to limit opening of the door during a collision of the vehicle.

According to another aspect of the present invention, a door handle assembly for a door of a vehicle includes a base portion mountable to the vehicle door, a handle portion configured to pivotally attach to the vehicle door, and a lever portion pivotally mounted to the base portion. The handle portion is pivotable between an initial position, where the handle portion is positioned generally along the vehicle door, and an actuating position, where the handle portion is pivoted away from the vehicle door. The lever portion includes a counterweight and a connector arm. The connector arm connects to a release mechanism of the vehicle door. The counterweight is substantially within the base portion when the handle portion is in the initial position. The lever portion pivots in response to pivotal movement of the handle portion, whereby pivotal movement of the handle portion toward the actuating position pivots the lever portion and actuates the release mechanism to open the vehicle door.

Therefore, the present invention provides a door handle assembly that has few components or a reduced number of components, and that may be readily adapted for use at a door at either side of a vehicle. The handle portion may be fixedly attached to the vehicle door, and the lever portion may have a reduced size, such that a counterweight is not needed to limit or substantially preclude opening of the vehicle door during a vehicle collision. The present invention also provides a door handle assembly that extends a reduced amount into the vehicle door, such that the vehicle door may have a reduced thickness. The door handle assembly may position a counterweight of the door handle assembly at least partially, and preferably substantially, within the base portion of the door handle assembly.

These and other objects, advantages, purposes and features of the present invention will become apparent upon review of the following specification in conjunction with the drawings.

DESCRIPTION OF THE PREFERRED EMBODIMENTS

Figure 1:
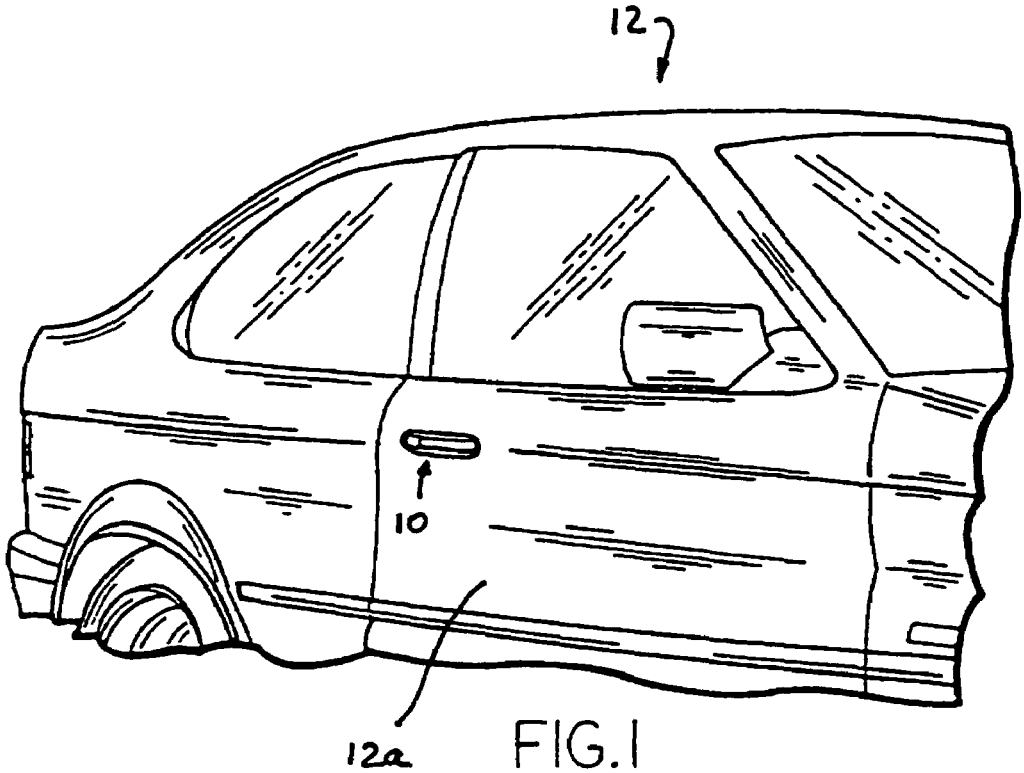
FIG. 1 is a perspective view of a vehicle with a door handle assembly in accordance with the present invention.

Referring now to the drawings and the illustrative embodiments depicted therein, a vehicle door handle assembly 10 is mountable to a door 12*a* of a vehicle 12 and operable to release a latch mechanism (not shown) of the door 12*a* to open the vehicle door (FIG. 1). Handle assembly 10 includes a handle portion 14 that is mountable to the vehicle door, a lever or lever portion or member 16 pivotally mounted to the handle portion 14, and an actuating portion or member 18 pivotally mounted to handle portion 14 (FIGS. 2-6). Actuating member 18 is connected to the door latch mechanism, such as via a cable or the like (also not shown), such that pivotal movement by lever 16 relative to handle portion 14 imparts a pivotal movement of actuating member 18 to release the latch mechanism to open the vehicle door, as discussed below.

Figure 2:
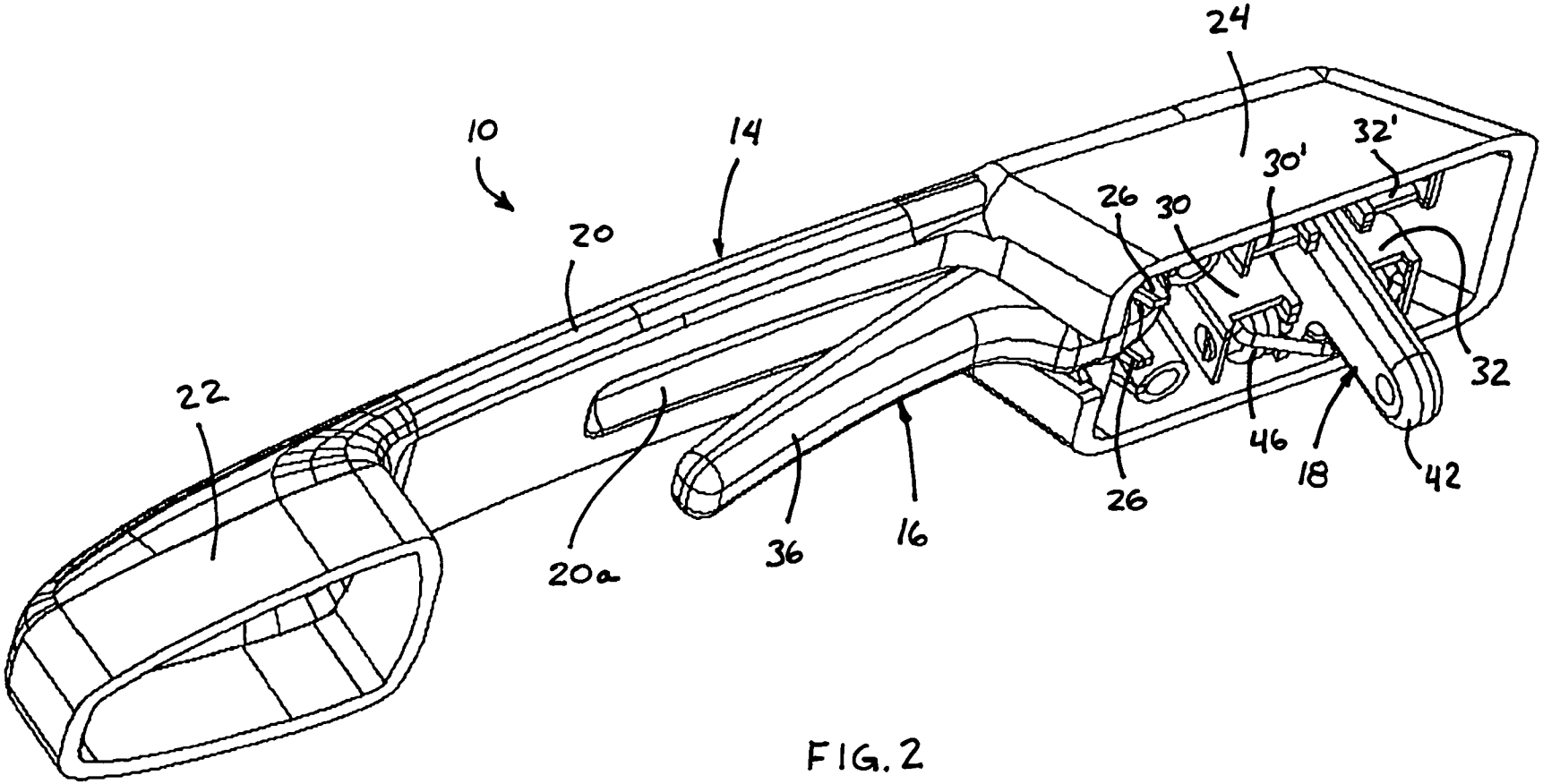
FIG. 2 is a perspective view of a door handle assembly of the present invention, with the door handle assembly removed from the vehicle door.
Figure 3:
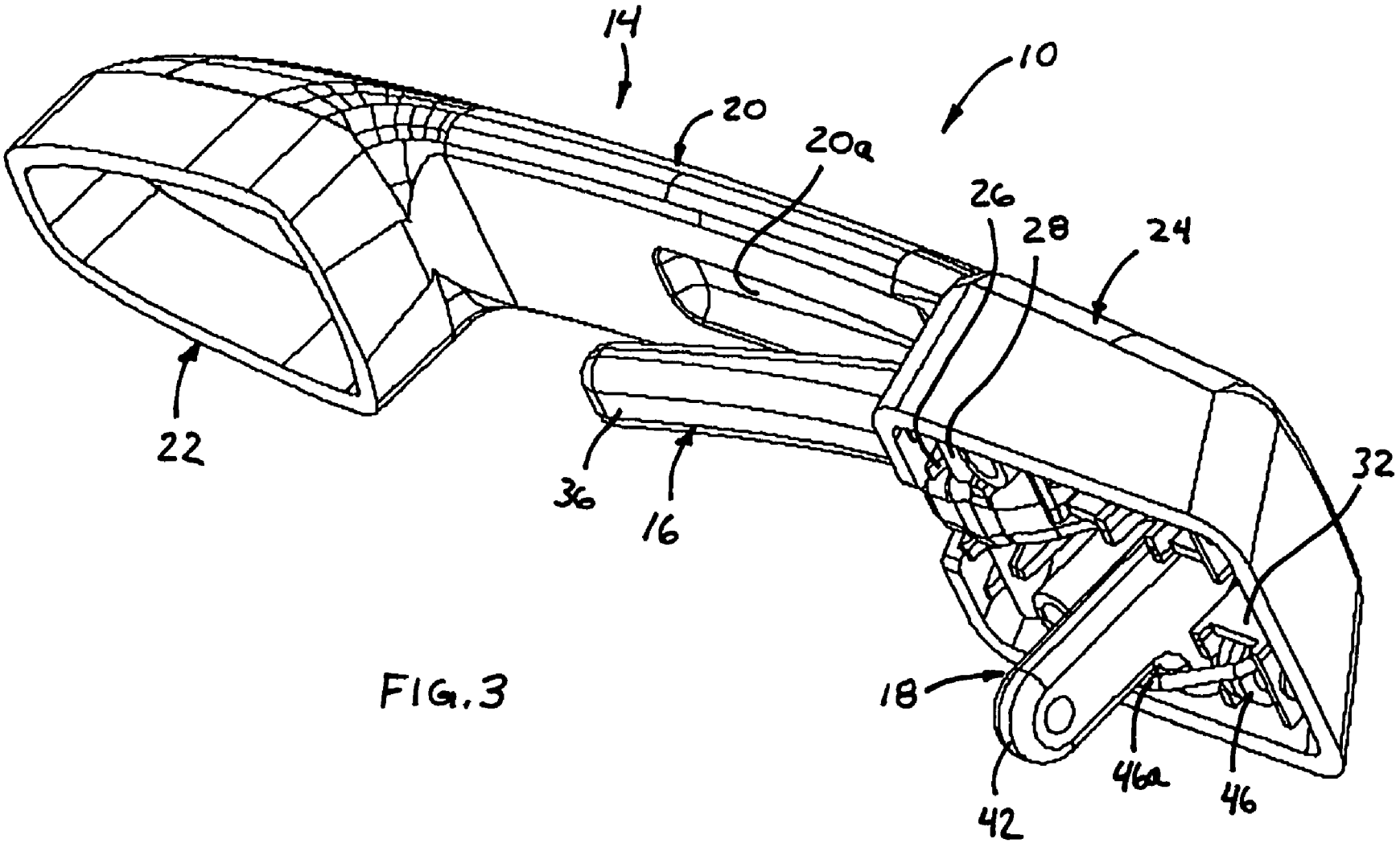
FIG. 3 is another perspective view of the door handle assembly of FIG. 2.
Figure 4:
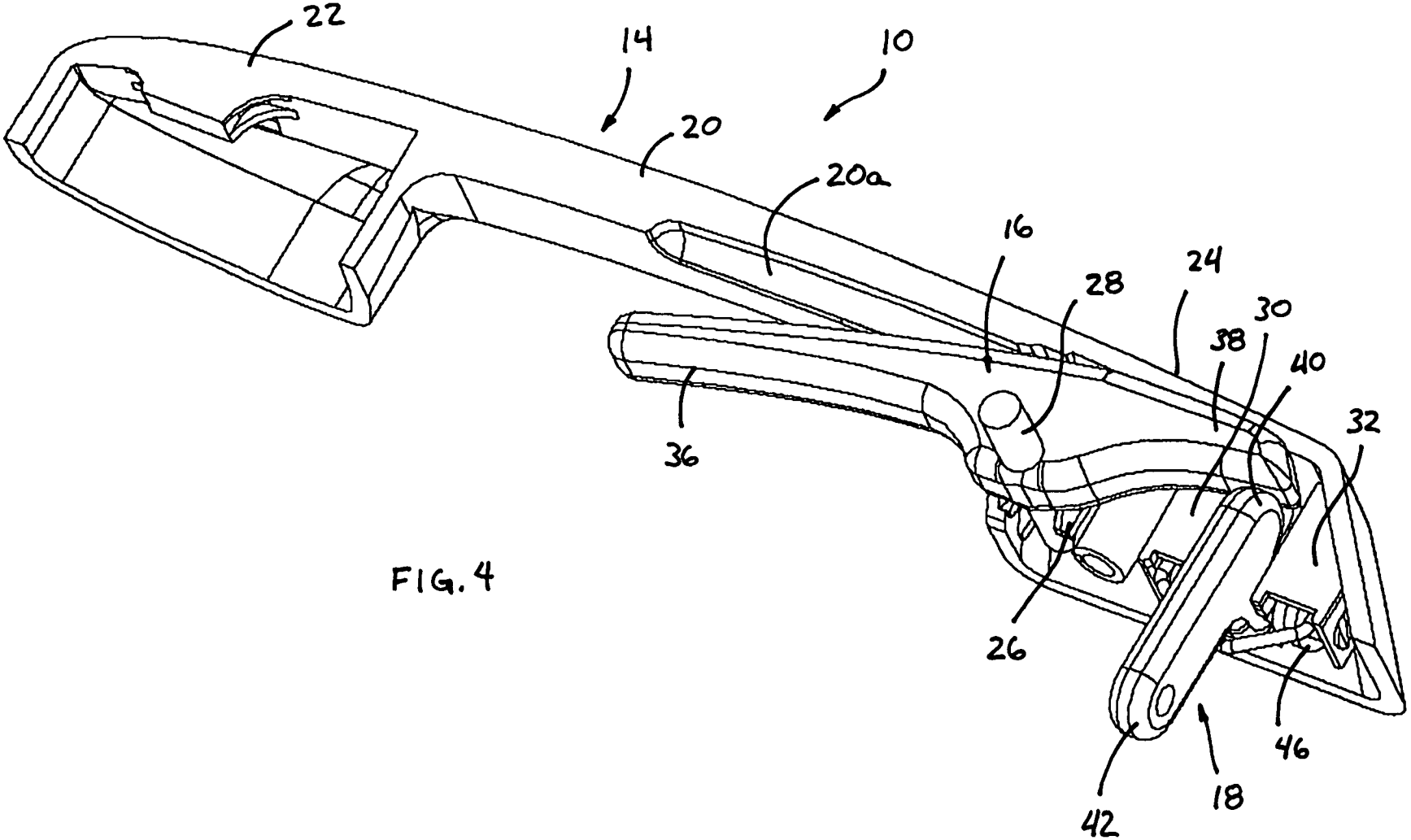
FIG. 4 is a perspective and partial sectional view of the door handle assembly of FIGS. 2 and 3.
Figure 5:
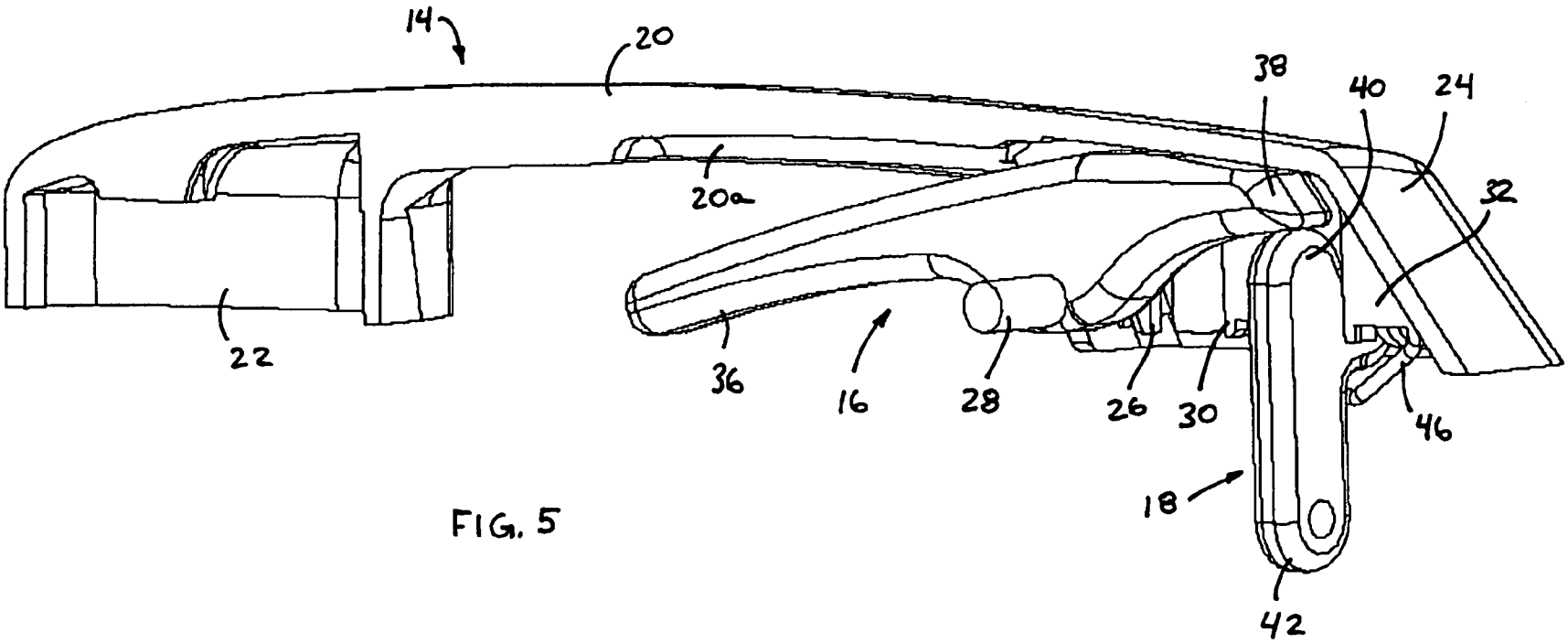
FIG. 5 is another perspective and partial sectional view of the door handle assembly of FIGS. 2-4.

Handle portion 14 includes a grasping portion 20 and opposite end portions 22, 24, which mount the handle portion to the vehicle door. As best shown in FIGS. 3-6, end portion 24 of handle portion 14 includes a pair of axle receiving portions 26 for pivotally receiving an axle portion 28 of lever 16, as discussed below. End portion 24 of handle portion 14 also includes a pair of axle receiving portions 30, 32 for pivotally receiving an axle portion 34 (FIG. 6) of actuating member 18, as also discussed below. As can be seen in FIG. 2, end portion 24 includes the axle receiving portions 30, 32 and 30', 32' at either side of the end portion 24 such that the handle assembly 10 may be readily reversed or flipped for use at either side of the vehicle door, as also discussed below.

Lever 16 comprises an elongated member that has a grasping end portion 36 and an actuating end portion 38 extending in generally opposite direction from the pivot axle portion 28. When axle portion 28 is received within axle receiving portions 26, actuating end portion 38 extends into end portion 24 of handle portion 14, while grasping end portion 36 extends from end portion 24 and generally along grasping portion 20 of handle 14, so that a user may grab or grasp the grasping portion 20 of handle 14 and readily grasp and move or pivot or actuate lever 16. Actuating end portion 38 engages an end 40 of actuating portion or member 18 to impart pivotal movement of actuating member 18 when lever 16 is pivoted by a user to open the vehicle door. Grasping portion 20 of handle portion 14 may also include a channel or recess 20*a* for partially receiving grasping end portion 36 of lever 16 when lever 16 is pivoted to open the vehicle door.

Actuating member 18 comprises an elongated member having an actuating end 40 that engages actuating end portion 30 of lever 16, and a connecting end 42 that connects to the door latch mechanism, such as via a cable or linkage the like. Actuating member 18 is pivotally mounted to end portion 24 of handle portion 14 via axle member 34. As can be seen with reference to FIGS. 2 and 6, axle member 34 is pivotally received within the receiving portions 30, 32, with actuating end 40 extending into end portion 24 and connecting end 42 extending into the door cavity when the handle assembly 10 is mounted to the vehicle door.

Figure 6:
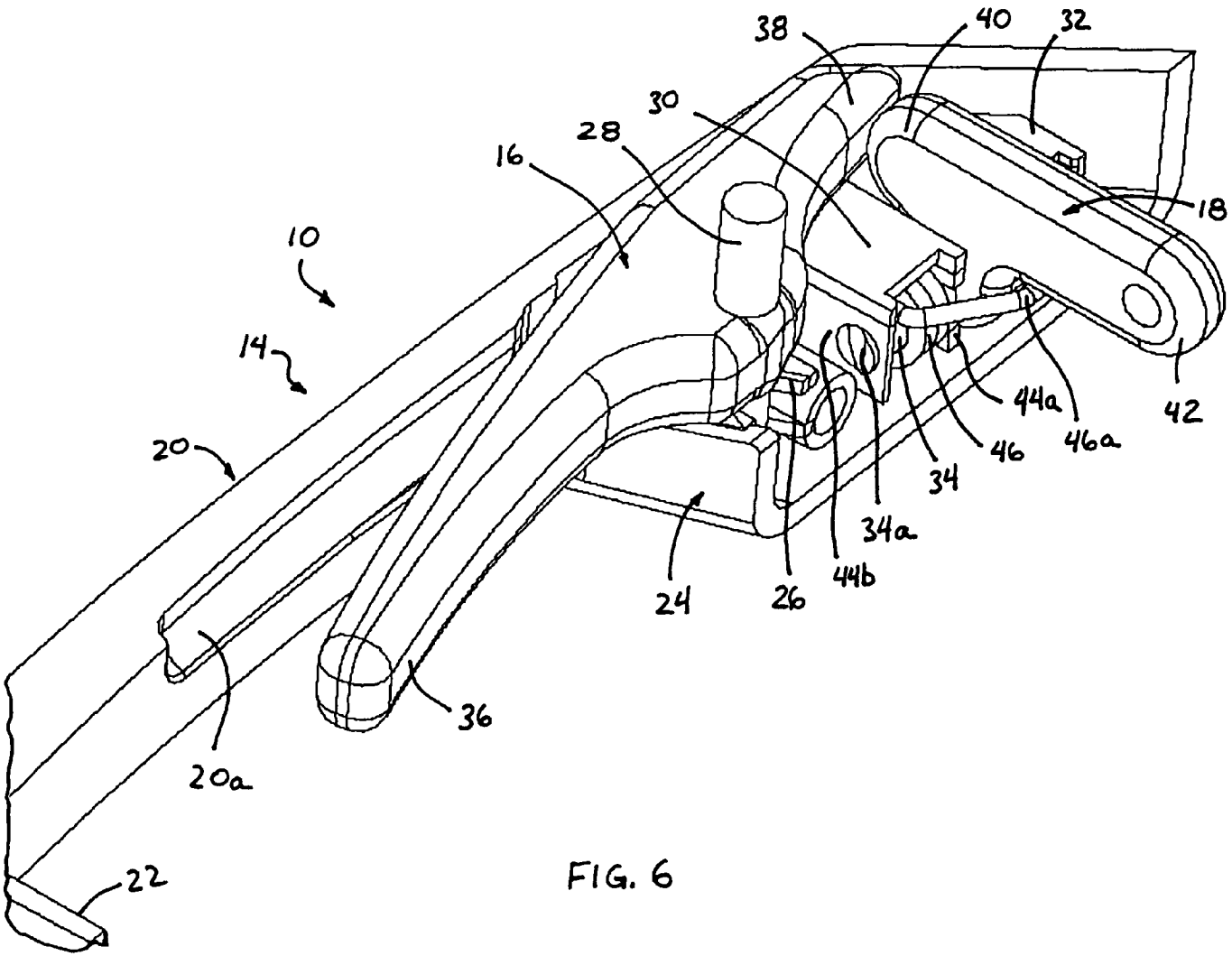
FIG. 6 is an enlarged perspective and partial sectional view of the door handle assembly of FIGS. 2-5.

As shown in FIG. 6, each receiving portion 30, 32 may comprise a slotted wall 44*a* and a retaining wall 44*b* spaced from slotted wall 44*a*. Axle member 34 includes an angled or tapered end 34*a* and thus may be pressed into the respective receiving portion. As the axle member 34 is pressed into the receiving portion, retaining wall 44*b* may flex to allow the end 34*a* of axle member 34 to move into the receiving portion until the end is generally aligned with an opening in the retaining wall 44*b*. The end 34*a* may then extend at least partially in or through the opening to substantially retain axle member 34 within the receiving portions 30, 32.

Handle assembly 10 may also include a biasing member or element or coil spring 46 or the like to bias the actuating member 18 at the initial or non-opening position. In the illustrated embodiment, biasing member 46 is a coiled spring that is coiled around the axle member 34 and positioned between slotted wall 44*a* and retaining wall 44*b* of each receiving portion 30, 32. One end (not shown) of biasing member 46 may be generally fixedly positioned at receiving portion 30, 32, while the other end 46*a* of biasing member 46 may extend outward from receiving portion 30, 32 and may engage actuating member 18 to urge or bias actuating member 18 toward its initial or non-actuated or non-opening position.

Accordingly, when lever 16 is pivoted or moved by a user, actuating end portion 38 engages and pivots actuating member 18 such that connecting end 42 pulls or moves the connecting cable or linkage or the like to actuate the latch mechanism to open the vehicle door. When the lever 16 is released, biasing member or members 46 urges the actuating member back toward its initial position, which in turn pivots lever 16 back toward its initial position.

Because end portion 24 of handle portion 14 includes receiving portions 30, 32 at either side thereof, handle assembly 10 may be readily reversed or flipped for use at a door at either side of the vehicle. For example, the door assembly 10 may be adapted or configured for use at a door at one side of the vehicle when actuating member 18 is received in the receiving portions 30, 32 as shown in FIGS. 2-6, but may be configured for use at a door at the other side of the vehicle if actuating member 18 is flipped around or reversed and the axle portion 34 of actuating member 18 is received in the other receiving portions 30', 32' (FIG. 2). The door handle assembly thus may be readily configured for use at either side of the vehicle without requiring additional components or different components between one side application and the other. The door handle assemblies for the doors on both the right and left side of the vehicle thus may have common components to reduce part proliferation in the assembly plant. The present invention thus provides a door handle assembly that includes few components and that reduces the part numbers for the assembly or manufacturing plant.

The door handle assembly 10 thus may include only four components, the handle portion, the lever portion, the actuating member and the biasing member or members. Because only the handle portion 14 is readily viewable by a person at the vehicle, the exterior surface of the handle portion may require a class A appearance (i.e. a surface readily viewable by a user of the vehicle and thus required to be aesthetically and functionally acceptable), while the other components need not provide such a finish or appearance. Preferably, the exterior surface of the handle portion is suitable for high yield decorative painting of the surface in a paint operation separate from the molding operations that form the class A surface. The present invention thus may reduce the costs of some of the components and thus of the overall door handle assembly by providing only one highly finished class A surface, without adversely affecting the appearance of the door handle assembly.

Also, because the lever 16 is pivotally movable relative to the generally fixed handle portion 14, the lever 16 provides a small movable component having substantially reduced mass relative to the pivotable handles of known handle assemblies. The lever of the door handle assembly of the present invention thus has reduced inertia during a vehicle collision or the like and thus does not tend to pivot and open the door during such collisions and the like. The door handle assembly of the present invention thus obviates the need for a counterweight to counter the inertia of the lever during such collision conditions. Because the handle assembly does not include such a counterweight, and because the lever and actuating member are at least partially or substantially within the end portion of the handle portion, the handle assembly may extend a reduced amount into the door cavity and, thus, may be suitable for use on thinner doors.

Figure 7:
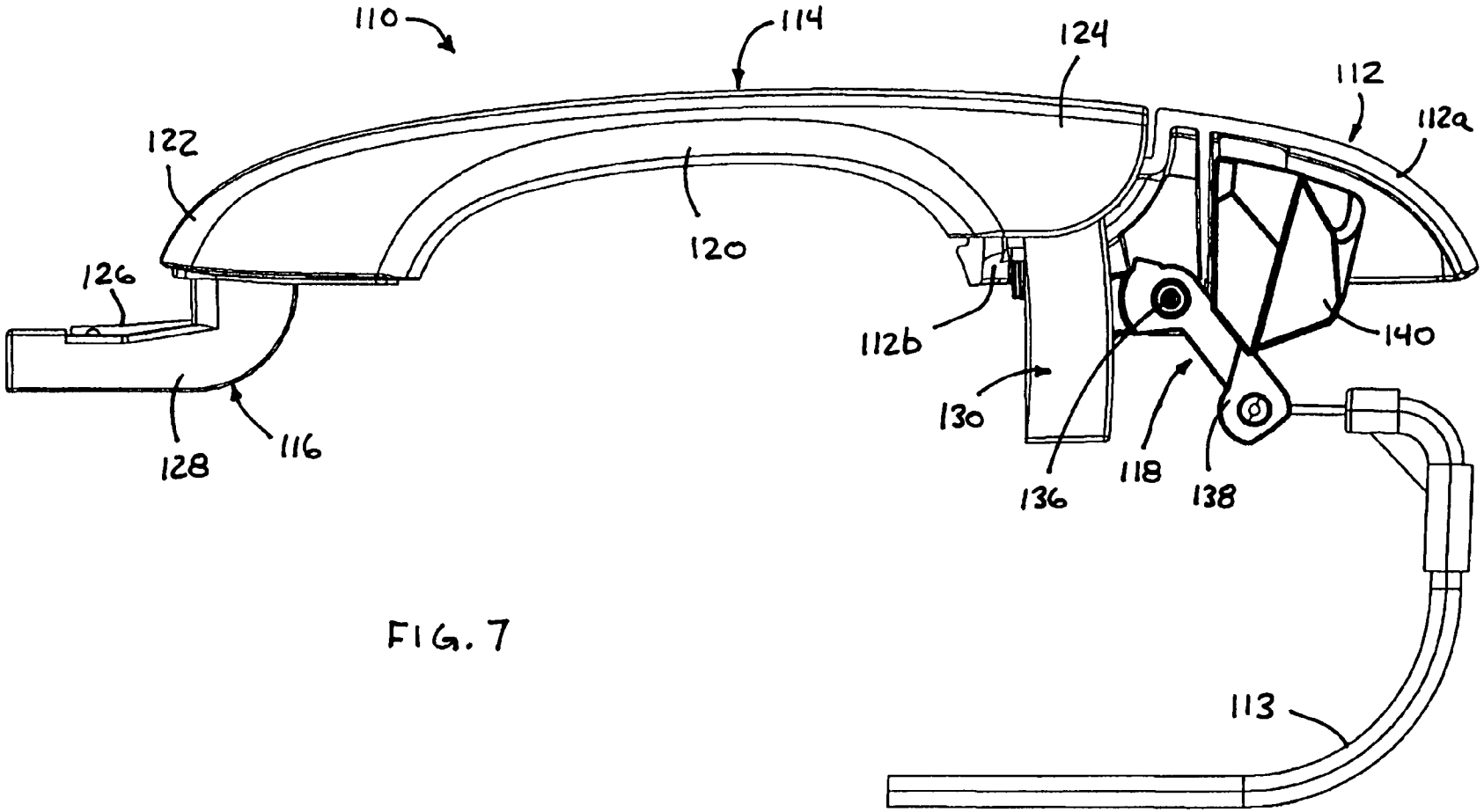
FIG. 7 is a top plan and partial sectional view of another door handle assembly of the present invention.
Figure 8:
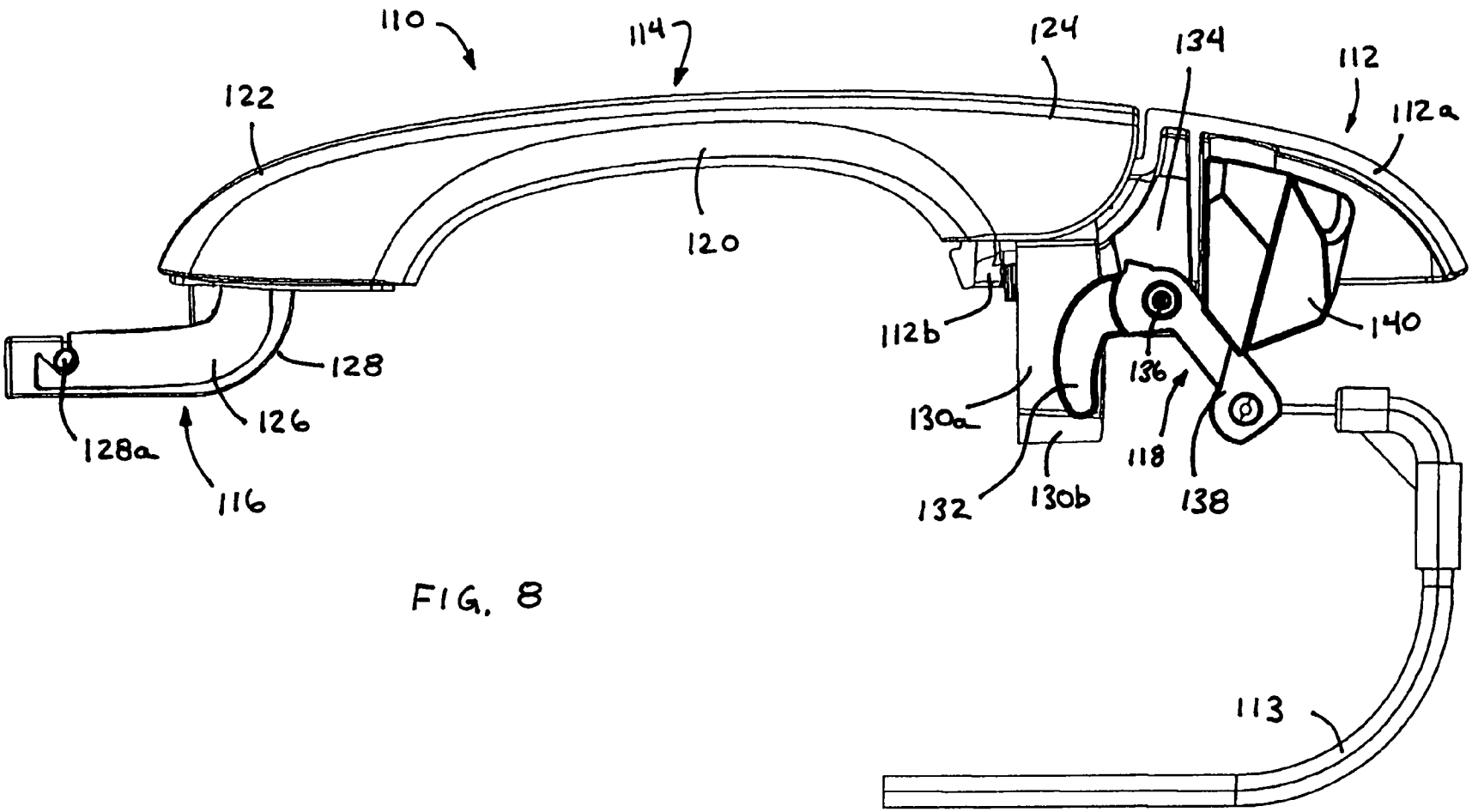
FIG. 8 is another top plan and partial sectional view of the door handle assembly of FIG. 7.
Figure 9:
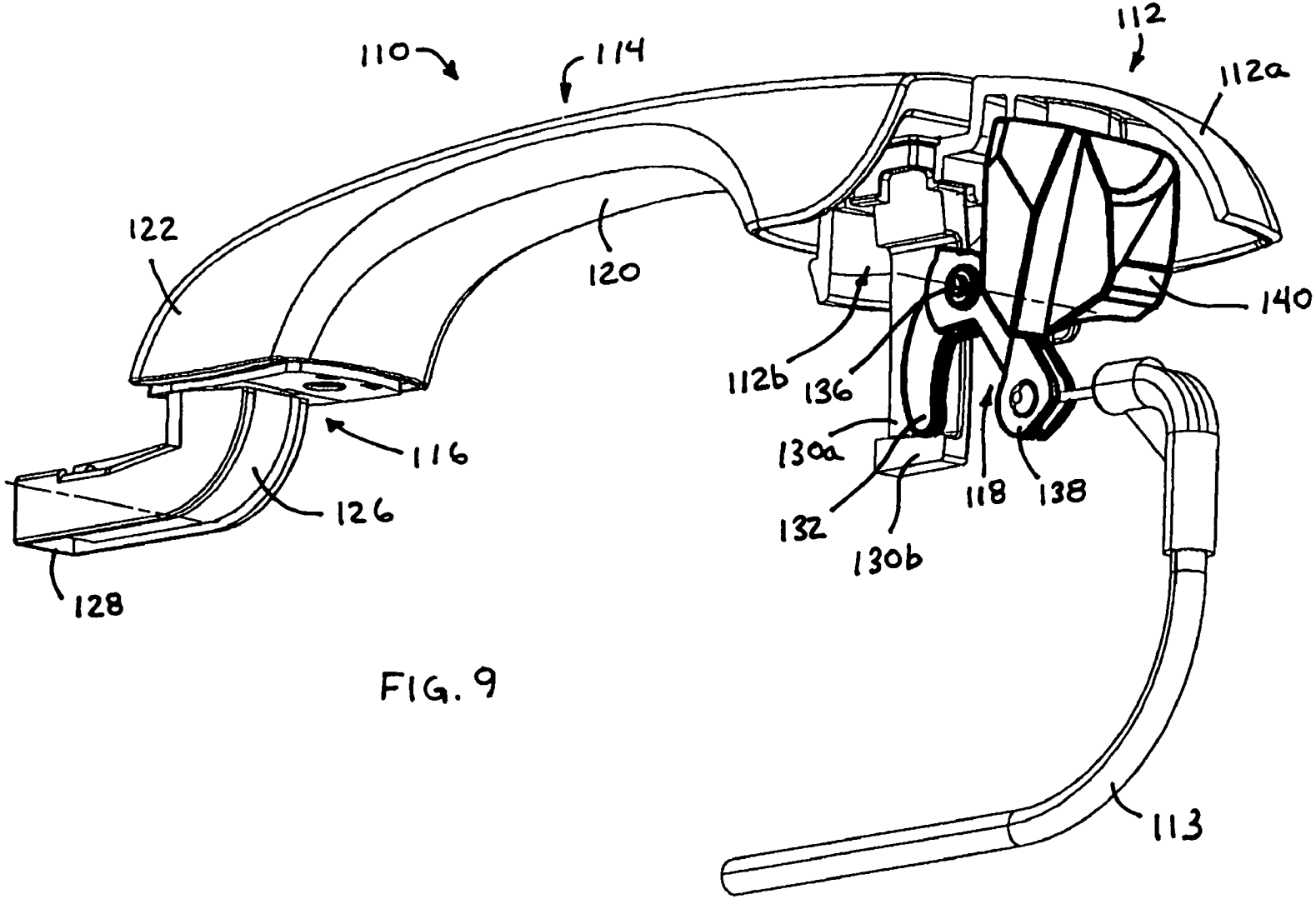
FIG. 9 is a perspective and partial sectional view of the door handle assembly of FIGS. 7 and 8.

Referring now to FIGS. 7-9, a vehicle door handle assembly 110 includes a base portion or case 112 that is mountable to a vehicle door and a handle portion 114 that is pivotally mounted to a second or front base portion or bracket 116, which is mountable to the door. Handle portion 114 is pivotable or movable relative to the door and the base portions 112, 116 to move an actuating lever or member or arm or bellcrank 118, which is connected to a cable or linkage 113 or the like to actuate or release the latch mechanism of the door to open the vehicle door (not shown in FIGS. 7-9), as discussed below.

Handle portion 114 includes a grasping portion 120 for a user to grab and pull at to open the vehicle door. The handle portion 114 also includes opposite end portions 122, 124 at opposite ends of the grasping portion 120. End portion 122 includes an L-shaped mounting arm 126 that pivotally mounts or attaches to a pin or member 128*a* of an L-shaped extension 128 of base portion 116, such as shown in FIG. 8. The L-shaped mounting arm 126 and extension 128 are positioned generally within the door when handle assembly 110 is mounted to the vehicle door. When a user pulls at grasping portion 120, handle portion 114 pivots about the pin 128*a* of base portion 116 while the opposite end portion 124 of handle portion 114 moves away from the door.

End portion 124 of handle portion 114 includes an extension 130 that extends toward and partially into the door. In the illustrated embodiment, extension 130 comprises a pair of walls 130*a* and an end plate or wall 130*b* for engaging an actuating arm or engaging end 132 of actuating lever 118, whereby outward movement of end portion 124 imparts a pivotal movement of actuating lever 118 to open the vehicle door, as discussed below.

Base portion 112 is mountable to the vehicle door and includes a housing portion 112*a* and an opening 112*b*. Extension 130 of end portion 124 of handle portion 114 extends through opening 112*b* of base portion 112 so that extension 130 moves relative to and through base portion 112 as handle portion 114 is pulled and released by a user. Base portion 112 includes a receiving portion or receiving arms 134 for receiving an axle portion 136 of actuating lever 118 so that actuating lever 118 is pivotally mounted to base portion 112.

Actuating lever 118 includes axle portion 136, with actuating arm 132 and a connecting arm 138 extending radially outward from axle portion 136. In the illustrated embodiment, actuating arm 132 is curved and extends between sidewalls 130*a* of extension 130 and contacts or engages end wall 130*b* of extension 130. Connecting arm 138 extends from axle portion 136 and is connectable to a cable or linkage 113, such that pivotal movement of actuating lever 118 about axle portion 136 causes connecting arm 138 to pull at cable 113 to actuate or release the latch mechanism of the vehicle door.

Actuating lever 118 further includes a counterweight 140 that is attached to and extends from connecting arm 138. Counterweight 140 and connecting arm 138 are configured so that connecting arm 138 extends into the door cavity for connection to the linkage 113, while counterweight 140 extends outwardly from the door. The counterweight is thus positioned substantially within the housing portion 112*a* when the handle portion is in its at rest or non-opening position (as shown in FIGS. 7-9). As can be seen in FIGS. 7-9, the counterweight 140 is positioned rearward of the pivot axis or pivot axle 136 of the actuating member 118 and outward of the pivot axis. When the door handle is mounted to the vehicle door, the counterweight is thus positioned at least partially rearward (toward the rear of the vehicle) and at least partially outward from the generally vertical pivot axis 136 of the actuating member.

Therefore, in the event of a sudden stop (such as may occur in a collision or the like), the handle portion may tend to pivot outwardly (due to the weight of the handle portion that is outside of the handle pivot axle 128*a*), but will be counter balanced and thus retained by the counterweight, which will tend to move forward (toward the forward end portion 122 of the door handle assembly and toward the front of the vehicle) and thus to pivot the actuating member toward the initial or non-opening position (such as in the counter-clockwise direction about pivot axis 136 in FIG. 8). Because the counterweight urges the actuating member toward its initial or non-opening position or orientation during a collision or sudden/rapid deceleration or stop, the counterweight limits or substantially precludes the actuating member from pulling at the cable 113, and thus limits or substantially precludes opening of the vehicle door during a collision or the like. The position of the counterweight relative to the pivot axle 136 thus functions to limit or substantially preclude unwanted door openings during vehicle collisions. Also, by positioning the counterweight at the casing and at least partially laterally outward from the door, the door assembly of the present invention may not extend substantially into the door cavity and, thus, may be suitable for applications to doors having a reduced width.

Although not shown in FIGS. 7-9, handle assembly 110 may include a biasing member or element or coil spring or the like to bias or urge the actuating lever, and thus the handle portion, toward the initial or at rest or non-opening position. For example, a coil spring may be positioned around the axle portion of the actuating lever, with one end of the coil spring engaging the base portion while the other end engages the actuating lever to urge the actuating lever toward the initial position relative to the base portion. Other biasing members or means for returning the handle portion to its initial position may be implemented without affecting the scope of the present invention.

Accordingly, when a user grabs at or grasps the handle portion and pulls outwardly away from the vehicle door, the handle portion pivots about the handle pivot axle or pin 128*a* of bracket 116 and pulls at actuating arm 132, which in turn pivots actuating member 118 about the actuator pivot axle 136 relative to base portion 112. The pivotal movement of actuating member 118 pulls at cable or linkage 113 to release the latch mechanism to open the vehicle door. When the handle portion is released, the biasing member or element may urge the actuating member 118 toward its initial position.

When the handle portion 114 is pulled or pivoted outwardly from the door, the counterweight 140 also pivots with actuating member 118 about pivot axle 136 to a position that is partially inward of the pivot axle and partially within the door cavity. However, due to the configuration of the actuating member and the housing portion of the base portion 112, the connecting arm and counterweight do not extend substantially into the door cavity throughout their range of pivotal movement, such that the door handle assembly of the present invention is suitable for application to a vehicle door with a reduced width or reduced distance between the exterior panel and the window that may be positioned within the door when the window is at least partially rolled down or lowered. The actuating member may be configured such that the connecting arm and counterweight extend into the door cavity during the range of pivotal movement, whereby the amount or depth of extension into the door cavity is about the same for both the initial and actuating positions.

Optionally, the handle assembly of the present invention may include a soft touch handle portion, such as utilizing the principles described in U.S. Pat. Nos. 6,349,450 and 6,550,103, which are hereby incorporated herein by reference. Optionally, the handle assembly may include an antenna or the like, such as for sensing or transmitting signals, such as described in U.S. patent. application, Ser. No. 10/256,707, filed Sep. 27, 2002 by March et al. for VEHICLE HANDLE ASSEMBLY WITH ANTENNA, now U.S. Pat. No. 6,977,619, which is hereby incorporated herein by reference. Optionally, the handle assembly may include an illumination source, such as described in U.S. Pat. Nos. 6,349,450 and 6,550,103, which are hereby incorporated herein by reference, where the illumination source may illuminate the handle portion or may provide ground illumination or safety illumination, such as described in U.S. Pat. Nos. 5,371,659; 5,669,699; 5,823,654; and 5,497,305, which are hereby incorporated herein by reference.

Therefore, the present invention provides a door handle that has few components and that may be readily adapted for use at a door at either side of the vehicle. The handle portion may be fixedly attached to the vehicle door, and the lever or lever portion may be a reduced size, such that a counterweight is not needed to limit or substantially preclude opening of the vehicle door during a vehicle collision. The handle assembly may include few components to provide further manufacturing and assembly savings. The handle portion may be the only class A surface component of the door handle, which may provide reduced costs. The handle assembly may be readily configured for application to a door at either side of the vehicle to further reduce the amount of part numbers at the assembly plant.

The present invention also provides a door handle that extends a reduced amount into the vehicle door, such that the vehicle door may have a reduced thickness. The door handle may position a counterweight of the door handle at least partially and preferably substantially within the base portion of the door handle. The counterweight may be positioned rearward and outward of the pivot axis of the lever portion such that the counterweight will provide enhanced performance of the door handle in collisions.

Changes and modifications to the specifically described embodiments may be carried out without departing from the principles of the present invention, which is intended to be limited only by the scope of the appended claims as interpreted according to the principles of patent law.

The embodiments of the invention in which an exclusive property or privilege is claimed are defined as follows:

1. An exterior door handle assembly mounted to a door of a vehicle, said exterior door handle assembly comprising:

a base portion mountable to the vehicle door so as to be at an exterior portion of the vehicle door and at an exterior side of the vehicle, at least a portion of said base portion extending laterally outwardly from the exterior side of the vehicle when said base portion is mounted to the door of the vehicle;

a handle portion configured to pivotally attach to the vehicle door and pivotable between an initial position, where said handle portion is positioned generally along the exterior portion of the vehicle door, and an actuating position, where said handle portion is pivoted away from the exterior portion of the vehicle door; and a lever portion pivotally mounted to said base portion, said lever portion including a counterweight and a connector arm, said connector arm engaging said handle portion and connecting to a release mechanism of the vehicle door, a substantial portion of said counterweight being within said base portion and external of the exterior portion of the vehicle door when said handle portion is in said initial position, said lever portion pivoting in response to pivotal movement of said handle portion, whereby pivotal movement of said handle portion toward said actuating position pivots said lever portion and actuates the release mechanism to open the vehicle door.

2. The exterior door handle assembly of claim 1, wherein said substantial portion of said counterweight is positioned rearwardly and laterally outwardly from a pivot axis of said lever portion when said handle portion is mounted to the vehicle door and in said initial position so that said counterweight functions to pivot said lever portion toward a non-opening position to limit opening of the vehicle door during a collision or sudden stop of the vehicle.

3. The exterior door handle assembly of claim 1, wherein said connector arm of said door handle assembly extends a lateral distance into the vehicle door when said handle portion is in said initial position, said connector arm of said door handle assembly extending approximately the same lateral distance into the vehicle door when said handle portion is moved to said actuating position.

4. The exterior door handle assembly of claim 1, wherein said handle portion includes an engaging portion that engages an engaging arm of said lever portion.

5. The exterior door handle assembly of claim 4, wherein said engaging arm extends from a pivot axis of said lever portion, said connector arm extending from said pivot axis.

6. The exterior door handle assembly of claim 5, wherein said counterweight extends from said connector arm.

7. The exterior door handle assembly of claim 6, wherein said connector arm extends at least partially into the door and said substantial portion of said counterweight extends into said base portion when said handle portion is in said initial position.

8. An exterior door handle assembly mounted to a door of a vehicle, said exterior door handle assembly comprising:

a base portion mountable to the vehicle door so as to be at an exterior portion of the vehicle door and at an exterior side of the vehicle;

a handle portion configured to pivotally attach to the vehicle door and pivotable between an initial position, where said handle portion is positioned generally along the exterior portion of the vehicle door, and an actuating position, where said handle portion is pivoted away from the exterior portion of the vehicle door; and a lever portion pivotally mounted to said base portion and pivotable about a pivot axis, said lever portion including an engaging arm, a connector arm and a counterweight, said connector arm connecting to a release mechanism of the vehicle door;

wherein a substantial portion of said counterweight is disposed laterally outboard of said pivot axis and at least partially within said base portion and at least partially external of the exterior portion of the vehicle door when said handle portion is in said initial position so that said counterweight functions to pivot said lever portion toward a non-opening position to limit opening of the vehicle door during a collision or sudden stop of the vehicle; and wherein said engaging arm is engaged by said handle portion and pivotally moved by said handle portion as said handle portion is moved between said initial position and said actuating position, and wherein pivotal movement of said handle portion toward said actuating position imparts pivotal movement of said engaging arm which in turn imparts pivotal movement of said connector arm about said pivot axis to actuate the release mechanism of the vehicle door.

9. The exterior door handle assembly of claim 8, wherein said counterweight extends from said connector arm.

* * * * *